US005217547A

United States Patent [19]

Ishikawa et al.

[11] Patent Number: 5,217,547

[45] Date of Patent: Jun. 8, 1993

[54] ALUMINUM ALLOY FIN MATERIAL FOR HEAT EXCHANGER

[75] Inventors: Kazunori Ishikawa, Nikko; Mituo Hashiura, Kariya, both of Japan; Yoshiharu Hasegawa, West Bloomfield, Mich.

[73] Assignees: Furukawa Aluminum Co., Ltd.; Nippondenso Co., Ltd., both of Japan

[21] Appl. No.: 701,845

[22] Filed: May 17, 1991

[51] Int. Cl.[5] ..... C22F 1/04

[52] U.S. Cl. ..... 148/552; 148/692; 148/415; 148/437; 420/548; 420/550; 420/551

[58] Field of Search ..... 148/2, 11.5 A, 12.7 A, 148/415, 437, 552, 692; 420/548, 550, 551

[56] References Cited

U.S. PATENT DOCUMENTS 4,244,756 1/1981 Tanabe et al. ..... 148/2

FOREIGN PATENT DOCUMENTS 2438111 2/1975 Fed. Rep. of Germany ..... 420/548
2-30375 1/1990 Japan .
2-133540 5/1990 Japan .
2-133553 5/1990 Japan .

*Primary Examiner*—R. Dean
*Assistant Examiner*—Robert R. Koehler
*Attorney, Agent, or Firm*—Breiner & Breiner

[57] ABSTRACT

The present invention relates to an aluminum alloy for fins of heat exchangers such as of automobile radiators and evaporators comprising 0.3 to 1.0% by weight of silicon, 0.3 to 3.0% by weight of iron, and the balance of aluminum and unavoidable impurities, which is readily workable for a fin (or readily corrugated), and is less deformed by brazing heat, and yet has improved thermal conductivity after the brazing.

4 Claims, 2 Drawing Sheets

ALUMINUM ALLOY FIN MATERIAL FOR HEAT EXCHANGER

BACKGROUND OF THE INVENTION

1. Field of the Invention

The present invention relates to an aluminum alloy for fins of heat exchangers such as of automobile radiators and evaporators, which is readily workable for a fin (or readily corrugated), and is less deformed by brazing heat, and yet has improved thermal conductivity after the brazing.

2. Related Background Art

A heat exchanger, such as a radiator for an automobile, is constructed, as shown in FIG. 2, by stacking a flattened tubes 3 being clad with a brazing metal on the surface thereof, and bare corrugated fins 1; attaching a header 4 to each side of the tubes 3 (FIG. 2 showing the upper side only); jointing them by brazing; and joining a tank 6 to the header by aid of a packing sheet 5. An evaporator for an automobile is constructed, as shown in FIG. 3, by stacking tube-constituting sheets 8 and 8' composed of brazing sheets for forming a coolant pathway 7 and 7' and bare corrugated fins 1 alternately, and jointing them by brazing.

The fins of such heat exchangers are made, for example, from a sheet of an alloy of JIS 3003, an aluminum-manganese type alloy, of about 0.1 mm thick. In the fin material, an element for making the potential of aluminum basic, such as zinc, tin, indium, and the like, is sometimes incorporated in order to attain a sacrificial effect for protecting the tube material for the coolant pathway from through-pitting corrosion caused by the air.

Such fin materials are required to have an appropriate strength at an ordinary temperature for working such as corrugation working and assemblage working of tube materials. The fin materials are usually exposed to a high temperature of 600° C. or higher when they are brazed, so that the fin material may sometimes be deformed by stress given by the tubes and jigs because of the thinness thereof to result in core deformation, failure of brazing, and so on. Accordingly, the fin materials are required to have sufficient strength and sufficient sag resistance at the high temperature. Incidentally, a thin material constituted by H14 alloy of JIS 3003 has strength of approximately from 14 to 18 kg/mm$^2$.

Recently, because of needs for more compactness and higher performance of heat exchangers, the fin materials are strongly desired to be made thinner and to have higher thermal conductivity. Since the cross-sectional area of the fin material for heat radiation comes to be less with less thickness of the fin, so that improvement is required for the thermal conductivity of the fin materials. Although JIS 3003 alloys can be made thin from the standpoint of the strength, the electric conductivity thereof is as low as 40% IACS owing to solid dissolution of the added manganese (about 1.1% by weight), and is at a lower level among aluminum alloys. Accordingly, the JIS 3003 alloys have been unsuitable for use for fin materials of higher performance.

SUMMARY OF THE INVENTION

The present invention intends to provide an aluminum alloy fin material for heat exchangers, which has balanced strength and thermal conductivity, and has high-temperature deformation resistance and sag resistance on heating by brazing, being particularly suitable for fin materials for radiators and evaporators which are subjected to heat on brazing.

The present invention provide an aluminum alloy fin material for heat exchangers comprising 0.3 to 1.0%, preferably 0.4 to 1.0% by weight of silicon (herein after the term "% by weight" is simply referred to as "%"), 0.3 to 3.0%, preferably 0.45 to 3.0% of iron, and the balance of aluminum and unavoidable impurities.

The present invention also provides an aluminum alloy fin material for heat exchangers comprising 0.3 to 1.0%, preferably 0.4 to 1.0% of silicon, 0.3 to 3.0%, preferably 0.45 to 3.0% of iron, 0.01 to 0.3% of zirconium, and the balance of aluminum and unavoidable impurities.

The present invention further provides an aluminum alloy fin material for heat exchangers comprising 0.3 to 1.0%, preferably 0.4 to 1.0% of silicon, 0.3 to 3.0%, preferably 0.45 to 3.0% of iron, and additionally one or more of 0.2 to 2.0% of zinc, 0.01 to 0.1% of tin, and 0.01 to 0.1% of indium; and the balance of aluminum and unavoidable impurities.

The present invention further provides an aluminum alloy fin material for heat exchangers comprising 0.3 to 1.0%, preferably 0.4 to 1.0% of silicon, 0.3 to 3.0%, preferably 0.45 to 3.0% of iron, 0.01 to 0.3% of zirconium, and additionally one or more of 0.2 to 2.0% of zinc, 0.01 to 0.1% of tin, and 0.01 to 0.1% of indium; and the balance of aluminum and unavoidable impurities.

DESCRIPTION OF THE PREFERRED EMBODIMENT

The alloy composition of the fin material of the present invention is limited because of the reasons below.

The addition of silicon and iron is effective for increasing the strength of the fin materials. The silicon content is limited to 0.3 to 1.0%, because at the silicon content of less than 0.3%, the aforementioned effect is not achievable, and at the silicon content exceeding 1%, the alloy comes to have lower melting point to exhibit remarkable sagging on brazing and to have lower thermal conductivity. The iron content is limited to 0.3 to 3.0%, because at the iron content of less than 0.3%, the effect is not achievable, and at the iron content exceeding 3.0%, the effect is saturated and the plastic workability of the alloy is reduced.

The addition of zirconium gives effects of increasing strength and sag resistance and coarsening the grains to retard high-temperature deformation. The zirconium content is limited to 0.01 to 0.3%, because at the content of less than 0.01%, the aforementioned effect is not achievable, and at the content exceeding 0.3%, the effect is saturated and the plastic workability and electric conductivity of the alloy are decreased.

The addition of any of zinc, tin, and indium makes the fin material basic to heighten the sacrificial anode effect. One or more of 0.2 to 2.0% of zinc, 0.01 to 0.1% of tin, and 0.01 to 0.1% of indium are added because below the lower limit each metal is not effective and above the upper limit the effect is saturated and the electric conductivity of the alloy is lowered.

In addition to the components above, incorporation of manganese, copper, chromium, manganese, and the like increases further the strength of the fin. The amount of the incorporation of such metals is not more than 0.3%.

The fin material of the present invention having the composition mentioned above is prepared in the manner shown below. The alloy having the composition below is cast, heat-treated at 450° to 600° C. for homogenization, hot-rolled and cold-rolled with one or more times of intermediate annealing, and finally cold-rolled at a cold-roll ratio of 15 to 60% after the final intermediate annealing to obtain the final sheet thickness.

The lower the homoganization temperature, the coarser is the grain of the fin material and the more is the sag resistance improved. The final cold-roll ratio of 15 to 60% gives appropriate hardness to the fin material, preventing the crushing or deformation of the fin at core assemblage and improving sag resistance at brazing.

The present invention is described specifically by reference to Examples.

EXAMPLES

The fin materials shown in Table 1 were cast in a mold in a conventional manner, and faced. The fin materials were homogenized at 520° C. for 3 hours, hot-rolled to give a thickness of 5 mm, cold-rolled to give a thickness of 0.15 mm, subjected to intermediate annealing at 380° C. for 2 hours, and finally cold-rolled to give a sheet of 0.1 mm thick.

Figure 1:
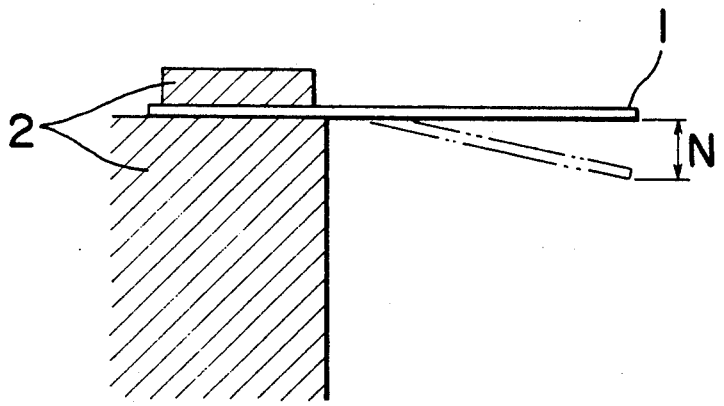
FIG. 1 illustrates an example of the sag test.
Figure 2:
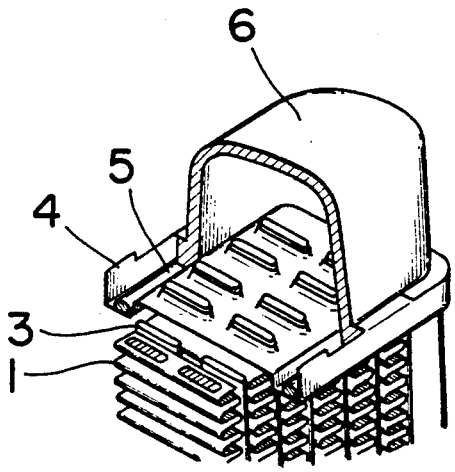
FIG. 2 is an oblique view of an example of a radiator for automobiles.
Figure 3:
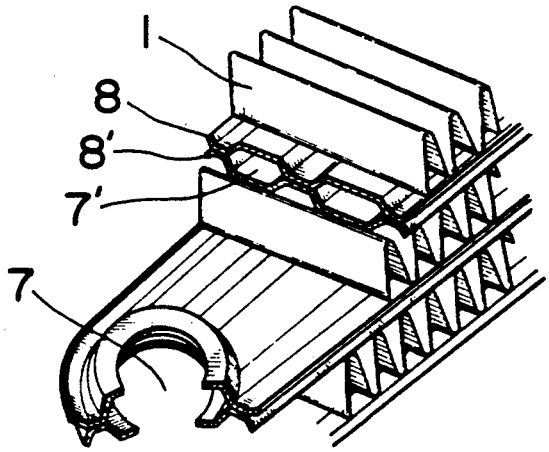
FIG. 3 is an oblique view of the main portion of an example of an evaporator for automobiles.

The fin materials were heated at 600° C. for 10 minutes in the air in imitation of brazing, and were tested for tensile strength and conductivity. Further the quantity of sag (N) of the material was measured, as shown in FIG. 1, by fixing one end of the fin material 1 with a jig 2 so as to project the fin material 1 in 50 mm in length from the jig 2, heating at 600° C. for 10 minutes in imitation of brazing. The sag (N) was measured three times and the average of the three measured values was obtained for each sample.

The above-described fin material was subjected to corrugation working. The corrugated article was formed into a radiator mini-core having joined fins and tubes by brazing the corrugated article with an electroseamed tube of 0.4 mm thick made of a core material of JIS 3003 alloy clad with JIS 4343 alloy-brazing metal, and brazing by use of a fluoride type flux in a nitrogen atmosphere at 600° C. for 10 minutes. The mini-core thus prepared was subjected to the CASS test (JIS H 8681) for 720 hours, and the depth of the pits developed on the tube was measured according to a focus depth method. The results are shown in Table 2.

As clearly shown in Table 1 and Table 2, any of the fin materials (No. 1 to No. 12) of the present invention, after brazing, has strength of not less than 8 kg/mm$^2$ and conductivity of not less than 50% IACS, and causes sag, by heat or brazing, of not more than 20 mm advantageously. The conductivity after brazing is much higher and the sacrificial effect is in the same level in comparison with those of No. 19 of the conventional fin material composed of JIS 3003 alloy. Although the strength is slightly low, the fin material of the present invention is satisfactorily useful with adjustment of the fin shape, the fin pitch, the corrugation height, and so forth.

On the contrary, Comparative fin materials No. 13 to No. 15 containing less silicon or iron are inferior in the strength after brazing, and Comparative fin materials No. 16 to No. 18 containing zinc, tin, indium or the like in a higher content exhibit a saturated corrosion resistance of the tube, and remarkably increased corrosion of the fin material.

Although the above description is made regarding a bare fin material, the fin material of the present invention is also useful as a core material of fins clad with a brazing metal for a serpentine type condenser and evaporators.

As described above, present invention enables production of a heat exchanger having superior heat exchange ability and sufficient structural strength without buckling of the fin on brazing by slightly changing the shape of the corrugated fin, which gives remarkable effect of compensating the decrease of heat exchanging ability caused by decrease of the radiation area when a fin is made thinner.

TABLE 1

| | | Composition (%) | | | | | | |
|---|---|---|---|---|---|---|---|---|
| Fin material | No. | Si | Fe | Zr | Zn | Sn | In | Al |
| Fin material of the invention | 1 | 0.3 | 0.4 | | | | | Balance |
| Fin material of the invention | 2 | 0.5 | 0.7 | | | | | " |
| Fin material of the invention | 3 | 0.8 | 1.0 | | | | | " |
| Fin material of the invention | 4 | 1.0 | 0.3 | | | | | " |
| Fin material of the invention | 5 | 0.5 | 1.5 | 0.05 | | | | " |
| Fin material of the invention | 6 | 0.5 | 1.5 | 0.15 | | | | " |
| Fin material of the invention | 7 | 0.3 | 2.5 | 0.15 | | | | " |
| Fin material of the invention | 8 | 0.5 | 1.3 | | 0.3 | | | " |
| Fin material of the invention | 9 | 0.5 | 1.3 | | | 0.02 | | " |
| Fin material of the invention | 10 | 0.5 | 1.3 | | | | 0.05 | " |
| Fin material of the invention | 11 | 0.5 | 1.5 | 0.10 | 1.5 | | | " |
| Fin material of the invention | 12 | 0.8 | 1.0 | 0.15 | 0.5 | 0.05 | | " |
| Comparative fin material | 13 | 0.2 | 1.5 | | | | | " |
| Comparative fin material | 14 | 0.8 | 0.25 | 0.10 | | | | " |
| Comparative fin material | 15 | 0.2 | 1.5 | 0.10 | | | | " |
| Comparative fin material | 16 | 0.5 | 1.3 | 0.10 | 2.5 | | | " |
| Comparative fin material | 17 | 0.5 | 1.3 | 0.10 | | 0.15 | | " |
| Comparative fin material | 18 | 0.5 | 1.3 | 0.10 | | | 0.15 | " |
| Conventional fin material (JIS 3003 + 1.5% Zn) | 19 | (Al—0.25Si—0.6Fe—1.1Mn—0.15Cu—1.5Zn) | | | | | | |

TABLE 2

| Fin material | No. | Tensile strength after brazing (kg/mm$^2$) | Conductivity after brazing (% IACS) | Sag on brazing (mm) | Maximum pit deptch (mm) |
|---|---|---|---|---|---|
| Fin material of the invention | 1 | 8.0 | 56 | 9 | 0.25 |
| Fin material of the invention | 2 | 8.7 | 54 | 13 | 0.22 |
| Fin material of the invention | 3 | 9.9 | 53 | 17 | 0.23 |
| Fin material of the invention | 4 | 9.0 | 52 | 18 | 0.22 |
| Fin material of the invention | 5 | 10.1 | 53 | 14 | 0.22 |
| Fin material of the invention | 6 | 10.5 | 53 | 13 | 0.20 |
| Fin material of the invention | 7 | 12.3 | 50 | 18 | 0.25 |
| Fin material of the invention | 8 | 9.3 | 54 | 15 | 0.15 |
| Fin material of the invention | 9 | 9.7 | 50 | 11 | 0.11 |
| Fin material of the invention | 10 | 9.4 | 53 | 15 | 0.12 |
| Fin material of the invention | 11 | 9.2 | 53 | 15 | 0.13 |
| Fin material of the invention | 12 | 10.0 | 51 | 10 | 0.13 |
| Comparative fin material | 13 | 7.5 | 54 | 9 | 0.25 |
| Comparative fin material | 14 | 7.7 | 52 | 15 | 0.23 |
| Comparative fin material | 15 | 7.9 | 52 | 11 | 0.22 |
| Comparative fin material | 16 | 9.8 | 47 | 11 | 0.12 |
| Comparative fin material | 17 | 9.7 | 52 | 13 | 0.13 |
| Comparative fin material | 18 | 9.7 | 52 | 13 | 0.13 |
| Conventional fin material | 19 | 11.0 | 39 | 8 | 0.20 |

What is claimed is:

1. An aluminum alloy fin material for heat exchangers consisting essentially of silicon in an amount of from 0.4 to 1.0% by weight, iron in an amount of from 0.45 to 3.0% by weight, 0.01 to 0.3% by weight of zirconium, and the balance being of aluminum and unavoidable impurities.

2. An aluminum alloy fin material for heat exchangers consisting essentially of silicon in an amount of from 0.4 to 1.0% by weight; iron in an amount of from 0.45 to 3.0% by weight; at least one member of the group consisting of 0.2 to 2.0% by weight of zinc, 0.01 to 0.1% by weight of tin and 0.01 to 0.1% by weight of indium; and the balance being of aluminum and unavoidable impurities.

3. An aluminum alloy fin material for heat exchangers consisting essentially of silicon in an amount of from 0.4 to 1.0% by weight; iron in an amount of from 0.45 to 3.0% by weight; 0.01 to 0.3% by weight of zirconium; at least one member of the group consisting of 0.2 to 2.0% by weight of zinc, 0.01 to 0.1% by weight of tin and 0.01 to 0.1% by weight of indium; and the balance being of aluminum and unavoidable impurities.

4. Process for preparing an aluminum alloy fin material for heat exchangers comprising casting an alloy consisting essentially of 0.4 to 1.0% by weight of silicon, 0.45 to 3.0% by weight of iron, 0.01 to 0.3% by weight of zirconium, at least one member of the group consisting of 0.2 to 2.0% by weight of zinc, 0.01 to 0.1% by weight of tin and 0.01 to 0.1% by weight of indium, and the balance being of aluminum and unavoidable impurities; heat treating said cast alloy at 450° C. to 600° C. for a time sufficient to provide homogenization of said cast alloy; hot rolling and cold rolling said heat treated alloy with at least one intermediate annealing; and following the final intermediate annealing, cold rolling at a cold roll ratio of 15 to 60% to obtain a final sheet thickness.

* * * * *